US007474226B2

(12) United States Patent
Mi et al.

(10) Patent No.: US 7,474,226 B2
(45) Date of Patent: Jan. 6, 2009

(54) SMOKE DETECTOR CALIBRATION

(75) Inventors: Zhexin Mi, Toronto, CA (US); William J. Rattman, DeLand, FL (US)

(73) Assignee: Tyco Safety Products Canada Ltd., Concord, Ontario (CA)

( * ) Notice: Subject to any disclaimer, the term of this patent is extended or adjusted under 35 U.S.C. 154(b) by 0 days.

(21) Appl. No.: 11/784,688

(22) Filed: Apr. 9, 2007

(65) Prior Publication Data

US 2007/0188337 A1 Aug. 16, 2007

Related U.S. Application Data

(62) Division of application No. 11/166,985, filed on Jun. 24, 2005, now Pat. No. 7,224,284.

(60) Provisional application No. 60/586,781, filed on Jul. 9, 2004.

(51) Int. Cl.
*G08B 17/10* (2006.01)

(52) U.S. Cl. ..... 340/628; 340/630; 340/514; 340/577; 340/583; 340/636.11

(58) Field of Classification Search ..... 340/628, 340/630, 514, 577, 583, 636.11
See application file for complete search history.

(56) References Cited

U.S. PATENT DOCUMENTS

| | | | | |
|---|---|---|---|---|
| 4,420,746 | A | | 12/1983 | Malinowski |
| 4,930,095 | A | | 5/1990 | Yuchi et al. |
| 4,977,527 | A | | 12/1990 | Shaw et al. |
| 5,155,468 | A | | 10/1992 | Stanley et al. |
| 5,172,096 | A | | 12/1992 | Tice et al. |
| 5,497,144 | A | | 3/1996 | Schappi et al. |
| 5,523,743 | A | | 6/1996 | Rattman et al. |
| 5,543,777 | A | | 8/1996 | Vane et al. |
| 5,546,074 | A | | 8/1996 | Bernal et al. |
| 5,552,763 | A | | 9/1996 | Kirby |
| 5,552,765 | A | | 9/1996 | Vane et al. |
| 5,699,043 | A | | 12/1997 | Vane et al. |
| 5,705,988 | A | * | 1/1998 | McMaster ..... 340/628 |
| 5,708,414 | A | | 1/1998 | Peltier et al. |
| 5,721,529 | A | * | 2/1998 | Vane et al. ..... 340/515 |
| 5,798,701 | A | * | 8/1998 | Bernal et al. ..... 340/628 |
| 5,821,866 | A | | 10/1998 | Bernal et al. |
| 5,936,533 | A | | 8/1999 | Bernal et al. |

FOREIGN PATENT DOCUMENTS

| | | | |
|---|---|---|---|
| EP | 0 580 110 | A1 | 1/1994 |
| JP | 2000 020852 | A | 1/2000 |

* cited by examiner

*Primary Examiner*—Tai T Nguyen

(57) ABSTRACT

A method for calibrating a smoke detector includes adjusting the sensitivity of the smoke detector to get a consistent pre-determined response over the expected operating range. The sensitivity is generally consistent for all detectors and an independent offset value is determined for each detector. This offset value basically corresponds to the signal from the detector in a clean atmosphere. The sensitivity of the smoke detector is determined by measuring the response at different levels of obscuration and then appropriately adjusting the output of the light source of the detector. This process is repeated until the desired sensitivity is achieved. Thereafter, the offset value is measured or calibrated and stored in the smoke detector for use in setting alarm values.

8 Claims, 6 Drawing Sheets

SMOKE DETECTOR CALIBRATION

RELATED APPLICATION(S)

This application is a divisional of U.S. application Ser. No. 11/166,985 filed Jun. 24, 2005 (Now U.S. Pat. No. 7,224, 284), which claims the benefits of U.S. Provisional Application No. 60/586,781, filed Jul. 9, 2004. The entire teachings of the above application(s) are incorporated herein by reference.

BACKGROUND OF THE INVENTION

The present invention relates to smoke detectors and in particular, relates to a method of calibrating a smoke detector. The invention also relates to a smoke detecting system where the alarm panel communicates with a series of calibrated smoke detectors.

Many smoke detectors include a light emitting diode(LED) light source that produces a light beam within a smoke detecting chamber. A photo diode is positioned to receive light that is scattered by smoke particles in the smoke chamber. The walls of the smoke chamber have a series of passages for allowing smoke particles to flow into or out of the chamber. The walls of the chamber are also designed to reduce the amount of light reflected by the walls back into the chamber. A processing circuit is associated with the photo detector to measure the amount of light received.

The various components of the smoke detector all collectively contribute to the sensitivity of the detector and the detector at the time of manufacture requires calibration. One of the main factors that lead to vary significant tolerance variations is the output of the LED light source. The output of the LED is adjusted to vary the sensitivity of the smoke detector. The calibration of smoke detectors to date has involved the adjustment of the output of the LED to achieve a particular alarm threshold measured by the photo detector for a known level of obscuration. Unfortunately, due to the significant variations in the tolerance of the LED, a considerable variation in the sensitivity of the smoke detector at various obscuration points occurs when this method of calibration is used.

To overcome this problem, it is possible to use LEDs with a smaller tolerance range; however, the problem is only reduced and the cost increases substantially.

The calibration method of the present invention reduces the problems associated with tolerance variation impact on calibration.

SUMMARY OF THE INVENTION

A method of calibrating a smoke detector according to the present invention is used for smoke detectors having a variable output LED light source, a smoke evaluation chamber, a light receiver, and a circuit for measuring the output of the light receiver. The method comprises providing the smoke evaluation chamber with a first known obscuration atmosphere and determining a first measured output of the light receiver. A second known obscuration atmosphere is then provided to the smoke evaluation chamber and a second measured output value of the light receiver is determined. The output of the LED light source is then adjusted based on the first and second measured output values to produce a predetermined sensitivity of the detector calculated by the ration of the change in measured output versus the change in obscuration. Once the predetermined sensitivity has been achieved, an offset value is determined for the particular detector. This offset value is used in combination with the predetermined sensitivity to predict the response of the detector for different levels of obscuration. The offset value is then used to set at least one alarm value.

According to a preferred aspect of the invention, the method includes selecting the first and second obscuration atmospheres to cover a wide operating range of the detector.

According to yet a further aspect of the invention, the first and second obscuration atmosphere correspond to an atmosphere greater than 2 percent per foot obscuration and an atmosphere less than 0.5 percent per foot obscuration.

According to yet a further aspect of the invention, the offset value is the measured output value of the light receiver corresponding to clean air.

According to yet a further aspect of the invention, the first and second obscuration atmospheres correspond to an atmosphere greater than 1.5 percent per foot obscuration and an atmosphere less than 0.8 percent per foot obscuration.

According to yet a further aspect of the invention, the circuit for measuring the output of the light receiver produces a digital value corresponding to the measured value of the atmosphere in the smoke evaluation chamber According to yet a further aspect of the invention, the method includes adding a predetermined value to the offset value to set the alarm value for the particular smoke detector.

In a further aspect to the invention, the method includes setting at lease three alarm values where each alarm value includes an associated predetermined value, and each alarm value is set by adding the respective predetermined value to the offset value of the detector to determine the alarm values.

A smoke detecting system according to the present invention comprises a control panel in two way communication with a series of smoke detectors where each smoke detector has a variable output LED light source, a smoke evaluation chamber, a light receiver and a circuit for measuring the output of the light receiver and further includes a stored offset value for determining alarm values and a predetermined sensitivity. The predetermined sensitivity is approximately equal for all of the smoke detectors. The stored offset value of each smoke detector is dependent upon the individual characteristic of each smoke detector and varies from one smoke detector to another. The alarm value for each detector is calculated by adding a fixed value associated with the alarm value to the stored offset value.

According to an aspect of the invention, the system includes the control panel providing the smoke detectors with the fixed value whereby the control panel effectively sets the alarm values for each detector.

In a further aspect of the invention, the alarm panel provides a first fixed value to a first group of detectors and a second fixed value to a second group of detectors such that said first group of detectors have an alarm value different from the alarm value of the second group of detectors.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
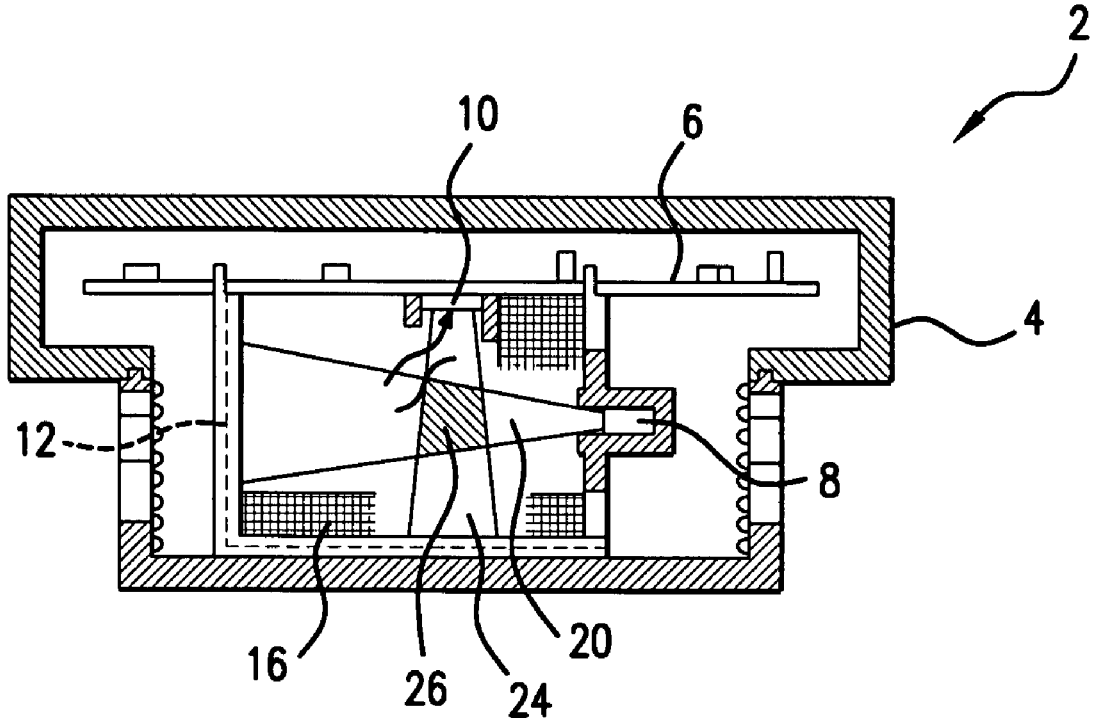
FIG. 1 is a cut away through a smoke detector showing the general structure thereof.

The smoke detector 2 shown in FIG. 1 includes an outer housing 4 which encloses the working components of the smoke detector. The smoke detector includes a circuit board 6, an LED light source 8, a photo detector 10 secured to the circuit board 6 and a smoke chamber 12.

The smoke chamber has a number of angled walls to allow smoke to enter the smoke chamber and to keep light out of the smoke chamber. An insect screen 16 is provided on the exterior of the smoke chamber to keep insects and large particles out of the smoke chamber.

The LED 8 in a clean atmosphere, would produce light which would generally follow the beam light pattern 20. The photo detector 10 is on the lower surface of the circuit board and is located to one side of the illumination beam and looks across the beam. The approximate line of sight of the photo detector is shown by the region 24. The crossover of the two beams defines a highly reactive zone 26.

This is the desired measuring zone where smoke particles, if present, will cause light to be reflected and some of this reflected light will strike the photo detector 10. Any light which strikes the smoke chamber walls is mostly dissipated or reflected in a manner not to contribute to the light received by the photo detector.

The above is typical of many smoke detectors and this structure is shown in our earlier U.S. Pat. No. 5,719,557.

A smoke detector at the time of manufacture is calibrated to provide consistent response. As can be appreciated the photo detector produces an electrical signal which preferably is converted to a digital signal. This digital signal is a measure of the amount of light received by the photo detector and is representative of smoke particles present in the atmosphere of the smoke chamber. Unfortunately, the light output of the LED has a large tolerance variation and the tolerance variation can be as much at 67 percent. There are other LEDs where the tolerance variation is less, however, given that there is a tolerance variation associated with the LED, and further tolerances associated with the photo detector, the circuit for converting the signal of the photo detector, as well as the smoke chamber itself, it is necessary to calibrate the unit.

Calibration is accomplished based on actual responses of the unit. Preferably, an atmosphere which represents a certain known percentage of obscuration is provided to the smoke chamber. The response or the output from the circuit which is a measure of the signal provided by the photo detector is then recorded. A second atmosphere is then introduced to the smoke chamber to provide a second assessment point. Preferably these atmospheres correspond to a relatively high smoke concentration, for example, 2.5 percent obscuration per foot, and a relatively low atmosphere, either a clean atmosphere or a level of less than 0.5 percent per foot of obscuration.

Based on these values, it can be determined whether the intensity of the LED should be increased or decreased to change the sensitivity to a predetermined value.

Figure 2:
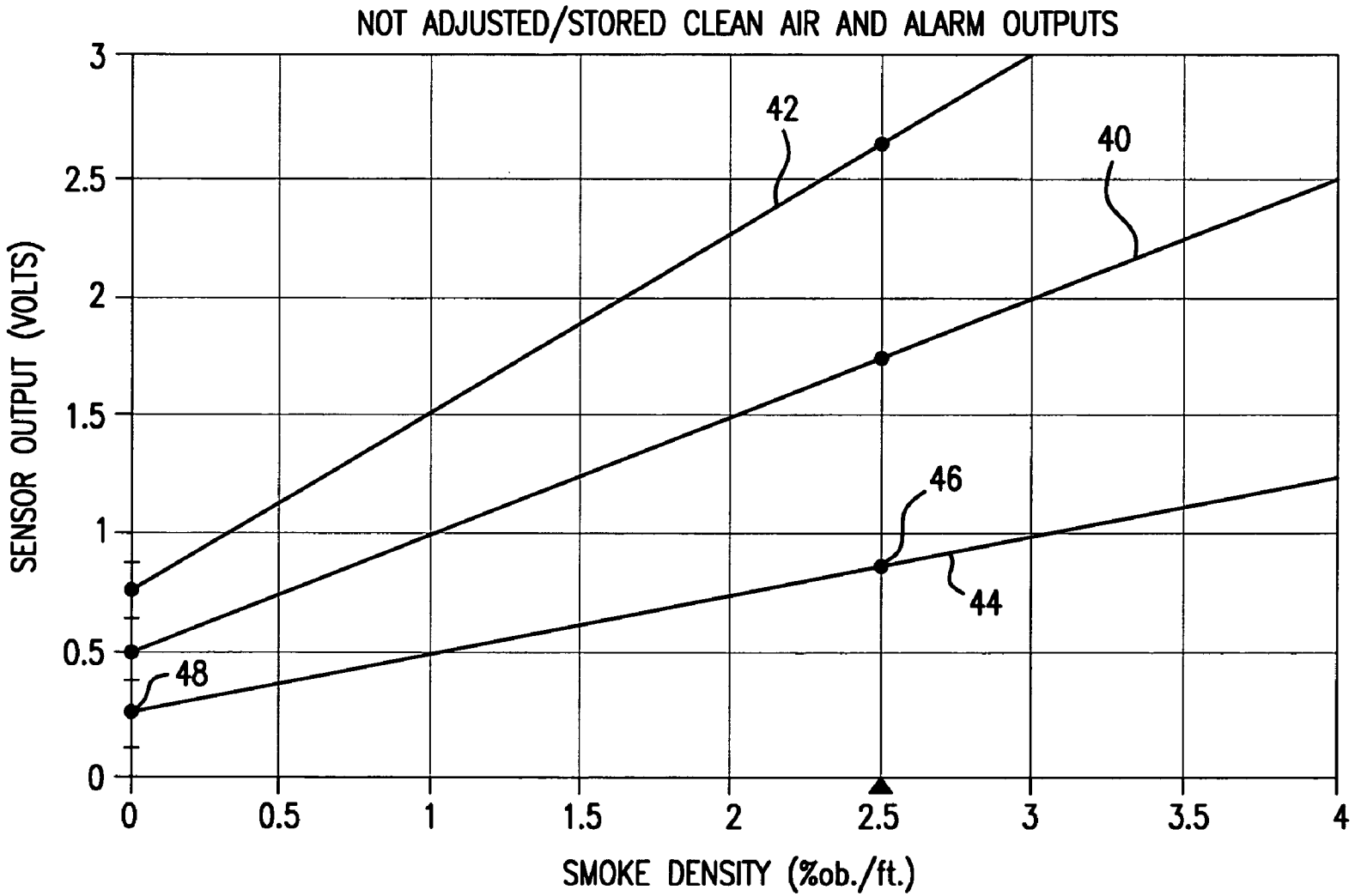
FIG. 2 is a graph of sensor output in volts versus smoke density of non-adjusted smoke detectors showing the maximum positive and negative tolerance variations.

FIG. 2 shows a graph of sensor output in volts versus smoke density measured as a percentage obscuration per foot. The middle line 40 shows a desired sensitivity measured by the slope of line 40 which is to be achieved. The upper line 42 represents the upper variation that is likely, if all the tolerances are in one direction, and line 44 shows the effect for the opposite tolerance variation. As can be appreciated, the actual sensitivity of the unit prior to calibration, could be represented by a line somewhere between lines 44 and 42.

The method of calibration after determining two points such as point 46 and point 48 associated with line 44, allows calculation of the slope of line 44 and the need to increase the light intensity. The light intensity can be increased or decreased, based on prior experience to attempt to achieve the slope of line 40. The corrected line 44 is basically adjusted to achieve the same slope as line 40, however, the "y" intercept of the graph will typically be different than the "y" intercept of line 40. By providing the same slope, the smoke detector over the range of 0.5 to 2.5 percent per foot obscuration will respond in a similar manner and has the same sensitivity. The smoke detectors will have different offset values corresponding to the respective "y" intercepts.

The adjusted sensitivity of the smoke detector can again be tested at the two atmosphere concentrations and determining the slope. Once it is known that the desired slope has been achieved, then a determination of the "y" intercept or offset value can be made. This offset value is the signal that is present in a clean atmosphere and this offset value is recorded by the smoke detector. The recorded value is used by the smoke detector for determining different alarm points. Given that the slope is the same for all units, or essentially the same for all smoke detectors, a fixed value can be added to the recorded offset value to determine the alarm point. In some cases, several alarm points are calculated and can be used.

Figure 3:
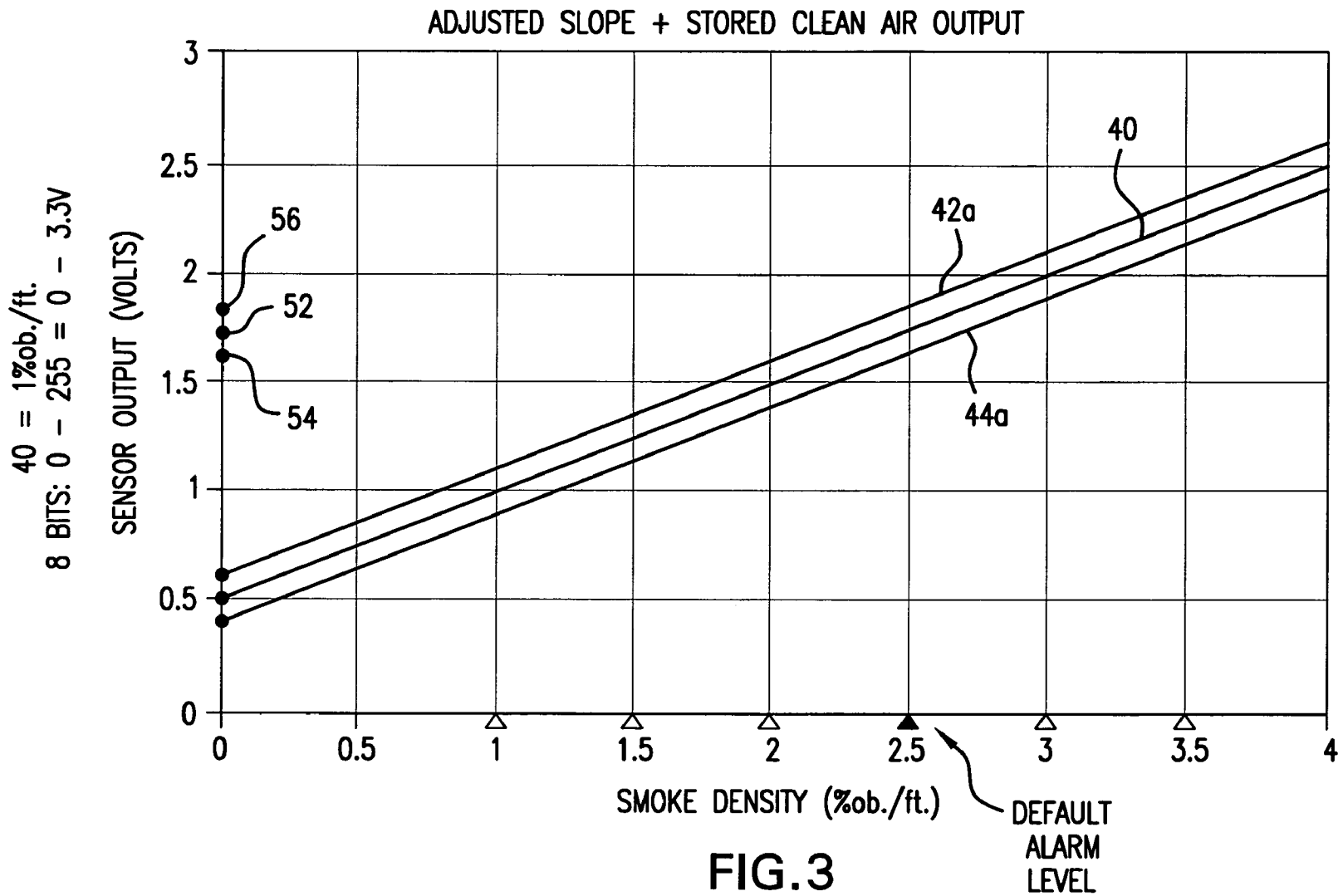
FIG. 3 is a graph of the sensor output versus smoke density for an adjusted smoke detector showing the extent of the plus and minus tolerance variation.

For example, FIG. 3 shows the alarm points which correspond to 1 percent, 1.5 percent, 2.5 percent, 3 percent and 3.5 percent obscuration. Unless instructed otherwise, the smoke detector typically has a default alarm level corresponding to 2.5 percent.

FIG. 3 shows the desired line 40 and adjusted sensitivity lines 42*a* and 44*a*. All of these lines have the same slope, and as such, each of the smoke detectors has the same sensitivity. Line 44*a* has an offset value of approximately 0.4, line 40 has an offset value of 0.5, and line 42*a* has an offset value of 0.6. Each of these values is recorded by the respective smoke detector.

The wide tolerance variation of the uncalibrated smoke detectors of FIG. 2 are shown in FIG. 3. Each of the smoke detectors represented by the three different sensitivity lines have the same sensitivity over the indicated alarm points between 1 and 3.5. Each of these detectors would have recorded their offset value and use this value in combination with a predetermined value to determine the alarm level.

For example, at the default alarm level 2.5, the smoke detector represented by line 40 has its alarm level indicated by 52 which has a value of 1.75. As can be seen, the smoke detector has an offset value of 0.5 and as such, the predetermined amount of 1.25 has been added to the offset value of 0.5 and thus, results in the alarm 52 of 1.75. In this example, the smoke detector represented by sensitivity line 44*a*, has an offset value of 0.4, and as such, would have an alarm point indicated by 54 having a value of 1.65.

Similarly, the smoke detector represented by sensitivity line 42*a* will have an alarm point indicated as 56 with a value of 1.85. The predetermined values for 1, 1.5, 2, 3 and 3.5, are also constant and based on the predetermined desired sensitivity indicated by the slope of the lines. The offset value is assessed once the desired slope has been obtained.

As can be appreciated, adjustment of the output of the LED will vary the slope of the line and if necessary, the calibration can go through a series of steps until the desired slope is obtained.

One of the advantages of the calibration of the smoke detector is the ease with which a control or alarm panel can communicate with the smoke detector and change the alarm points. As stated, the smoke detectors are calibrated such that they have a generally equal sensitivity. Each smoke detector records a clean air value which is used for determining the alarm threshold based on adding to this value a predetermined amount based on the percentage obscuration which is to be measured. For example, the control panel can merely instruct all the smoke detectors to add to their intercept value, the appropriate value for an alarm condition at 2.5. It would also be possible for the control panel to instruct certain of the smoke detectors to use an alarm level of 1.5 and other detectors to operate at an alarm level of 2.5

Figure 6:
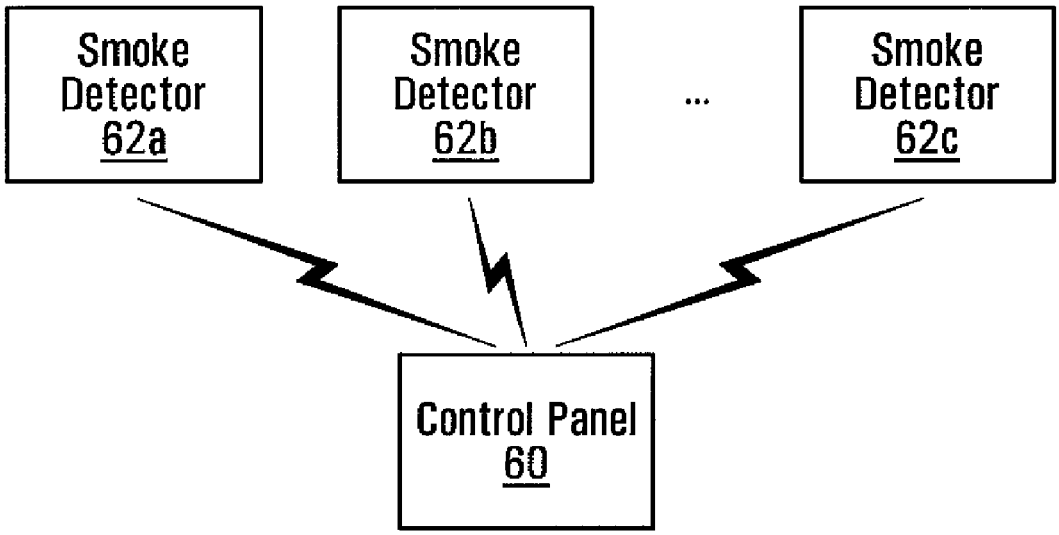
FIG. 6 is a schematic block diagram of a smoke detecting system, exemplary of an embodiment of the present invention.

As far as the control panel is concerned, the smoke detector merely takes the value provided or the instruction provided by the control panel and performs the appropriate calculation to determine the alarm point. To this end, FIG. 6 illustrates a control panel 60 in two-way communication with a series of smoke detectors 62*a*, 62*b*. . . 62*c*, exemplary of an embodiment of the present invention.

It has also been found that by achieving a consistent sensitivity, the response of all smoke detectors is more uniform and the effect of aging components and/or the accumulation of some dust in the smoke detectors is more consistent and causes less difficulty. As can be appreciated, there can be a small drop in the sensitivity due to aging of the components which results in the slope of the line marginally decreasing, and the line shifting slightly, downwardly. This would correspond to a reduction in the output of the LED for example.

This possible condition can be compensated for by using a number of different techniques. One technique is to maintain a history of readings of the smoke detector over a long period of time and this assumption assumes that on average, the atmosphere which is presented to the smoke detector should be consistent. If there is a reduction in the output of the photo detector, then this reduction is due to aging of the components and based on the amount of reduction, suitable compensation can be made as will be explained relative to FIG. 5.

As the age of the smoke detector increases, it is also possible that there can be an accumulation of dust particles in the chamber and this causes the signal to increase. Again, based on an historical average or suitable testing procedure, this can be tracked over time and suitable adjustments can be made.

Figure 4:
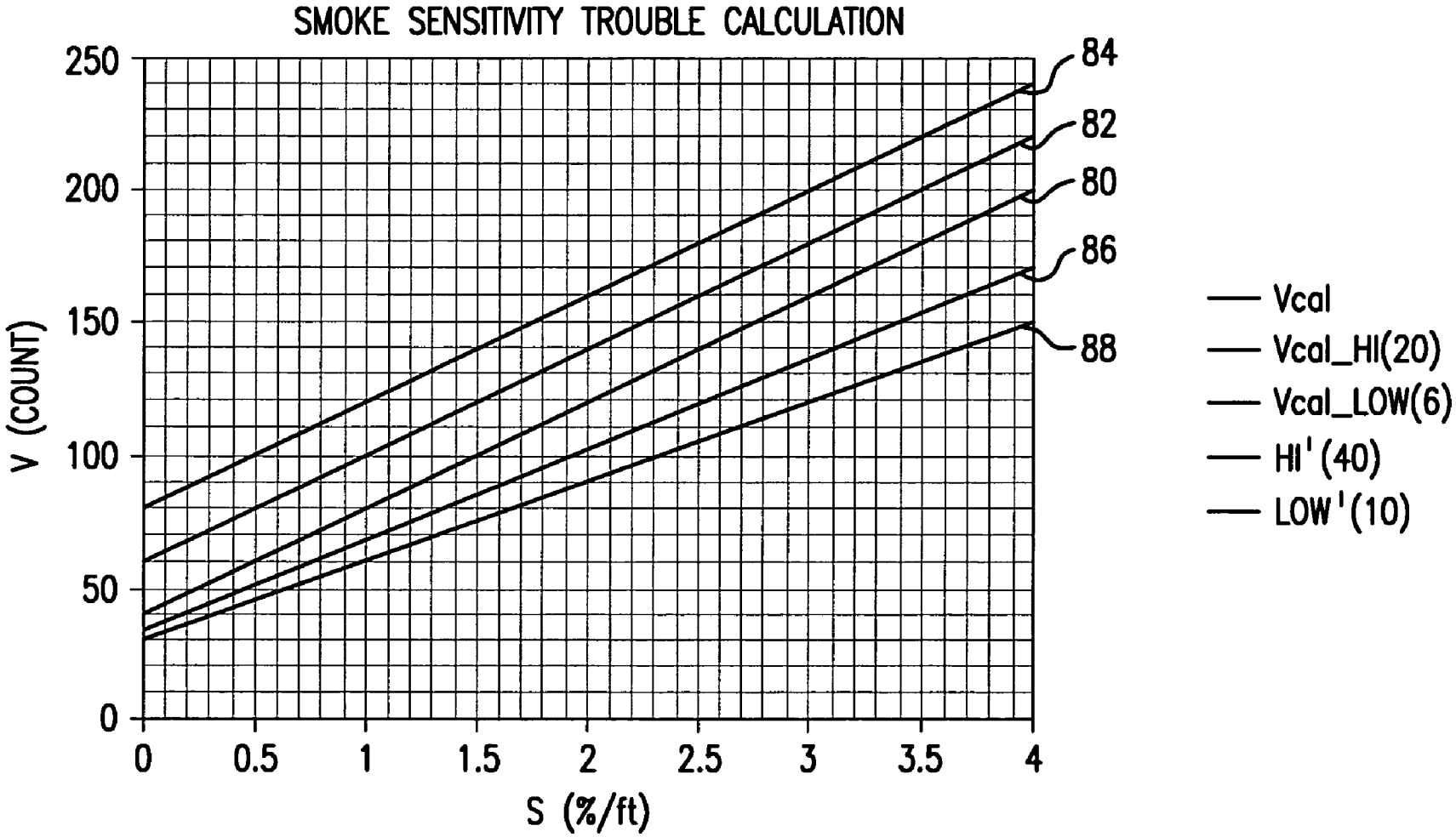
FIG. 4 shows an adjusted smoke detector graph and the response of the detector after sensitivity draft.

FIG. 4 has a center response line 80 which is the calibrated response at the time of manufacture. Lines 82 and 84 represent a higher response due to two different dust accumulation levels. This type of condition generally maintains the slope but shifts the response line up. In contrast, lines 86 and 88 are of decreasing slope and represent field conditions due to age, such as reduced LED output. A higher signal due to dust can have a fixed adjustment value based on measured signals. Aging of components requires a different approach.

Figure 5:
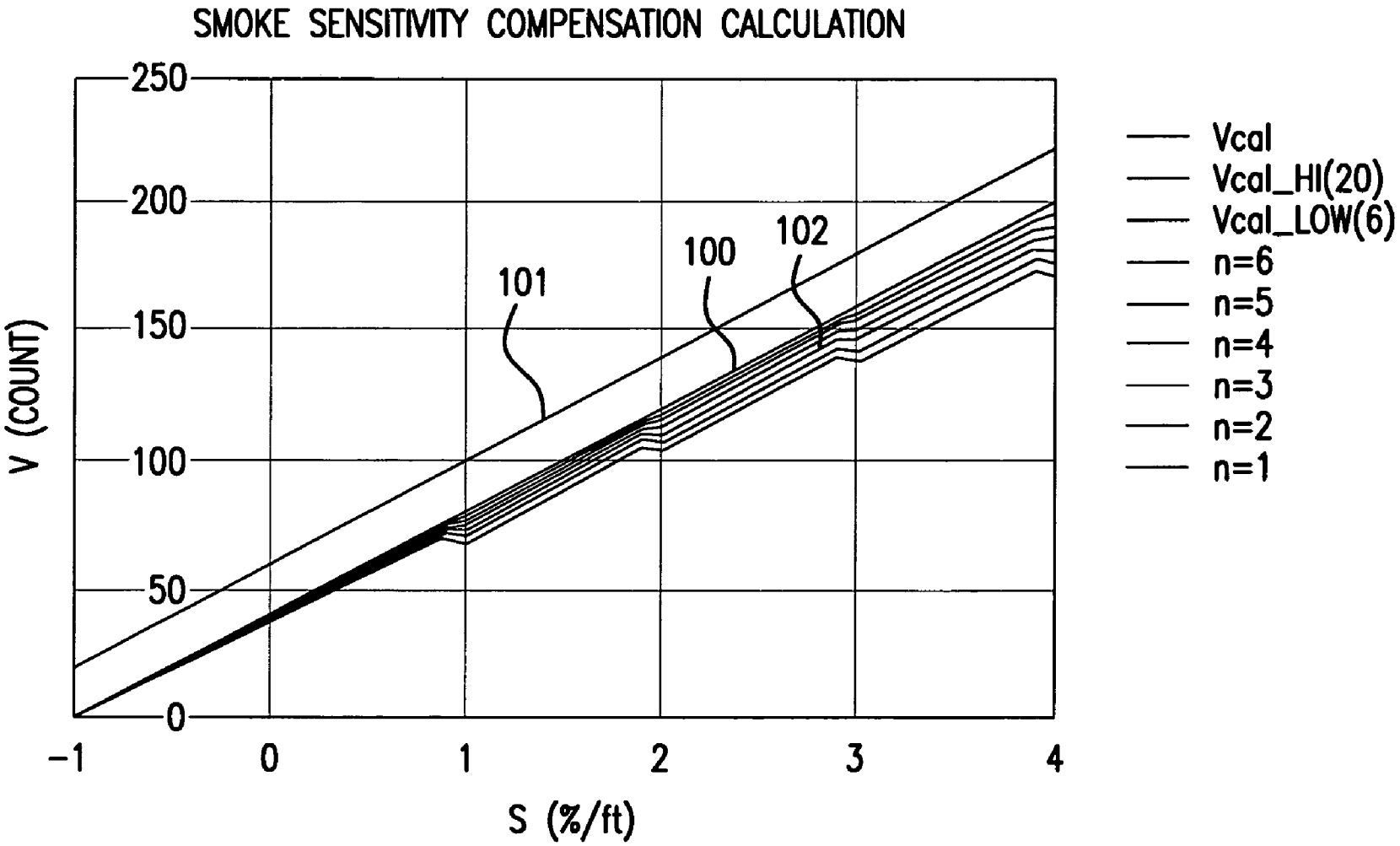
FIG. 5 shows a further feature of the invention where the smoke detector, after calibration, and in normal use, provides a compensation factor which varies according to the alarm level for a particular obscuration point.

FIG. 5 shows the normal calibrated response line 100 and top line 101 where a constant value is added to all alarm values. Unfortunately, as shown in FIG. 4, a constant or fixed adjustment value does not fully correct for the reduction in slope.

In FIG. 5 it can be seen that there are a series of lines 102 which include transition points in advance of various set obscuration points, namely; at 1 percent, 2 percent, 3 percent and 4 percent. The historical value of the smoke detector is compared with its stored value and if this has dropped somewhat, then appropriate compensation can be determined as a function of the alarm level. The compensation lines indicated at N1 through N6 show six compensation examples.

The straight line approximation for compensation for reduced response over the entire obscuration operating range has not proven entirely satisfactory and it is desirable to provide a series of steps shortly before the alarm points. As shown in FIG. 5, a straight line approximation is used in stages with one stage being for values between alarm point 1 and 1.5 based on a corrected historical value. For example, it may have been determined that the sensitivity was decreased from the original response line 100 to drop down two lines to the line indicated as 102. Based on this historical assessment, the alarm points can then be corrected depending upon what particular alarm point has been set by the control panel or the smoke detector. Thus, the correction line 102 which is made up of a series of step segments to change the amount of correction as the senses signal increases. The straight line segments of line 102 make the calculation relatively simple for each stage and the series of straight line segments adjusts for the changing slope. The amount of correction in this case is the difference between line 100 and line 102. In this case, the alarm level is reduced by this difference which varies in stages as the sensed obscuration increases.

A fixed corrective amount is known based on historical values and this corrective value is increased in stages as the sensed level of obscuration increases. In this way, the correct compensation is calculated as a function of the assessed normal value and the sensed response level.

Basically line 102 shows the corrected value although there are various ways to perform this adjustment in the smoke detector.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A smoke detecting system comprising a control panel in two way communication with a series of smoke detectors wherein each individual smoke detector comprises a variable output LED light source, a smoke evaluation chamber, a light receiver, a predetermined sensitivity value and a circuit for measuring output of the light receiver and for providing a digital output representing a measure of obscuration of the light receiver, the circuit storing an offset value dependent on characteristics of the individual smoke detector and an alarm value wherein said predetermined sensitivity is approximately equal for all of said series of smoke detectors and each alarm value for a respective one of said series of smoke detectors is calculated by adding a fixed predetermined value to said stored offset value, wherein the fixed predetermined value is based upon the predetermined sensitivity value.

2. A system as claimed in claim 1 wherein said smoke detectors are programmable by said control panel and said fixed value is provided by said alarm panel to said detectors and said detectors use said fixed predetermined value to determine the alarm value for the respective detector.

3. A system as claimed in claim 2 wherein said control panel provides a first fixed value to a first group of detectors and a second fixed value to a second group of detectors such that said first group of detectors have an alarm value different from the alarm value of said second group of detectors.

4. A system as claimed in claim 1 wherein said offset value is the measured output value of said light receiver corresponding to a clean air atmosphere.

5. A system as claimed in claim 1 wherein said circuit for measuring the output of said light receiver produces a digital value corresponding to the measured value of the atmosphere in the smoke evaluation chamber.

6. A system as claimed in claim 1 including setting at least 3 alarm values where each alarm value has a different predetermined value and each alarm value is set by adding the respective predetermined value to said offset value to determine the alarm value.

7. A system as claimed in claim 1 wherein the variable output LED light of each smoke detector has been adjusted to provide said predetermined sensitivity.

8. A smoke detector comprising:

a variable output LED light source;

a smoke evaluation chamber;

a light receiver and a circuit for measuring the output of the LED light source;

said LED light source adjusted to provide a predetermined sensitivity of the detector calculated by the ratio of change in measured output versus change in obscuration;

a circuit in communication with said light receiver, said circuit providing a digital value representing obscuration of said light receiver, said circuit storing an offset value to be used in combination with said predetermined sensitivity to predict the response of the smoke detector to different levels of obscuration of the light receiver; said circuit further storing an alarm value signifying an alarm, said alarm value formed by adding a fixed value to said offset value.

* * * * *